US009694617B1

(12) United States Patent
Dennis et al.

(10) Patent No.: US 9,694,617 B1
(45) Date of Patent: Jul. 4, 2017

(54) MUSICAL GREETING CARD

(71) Applicant: American Greetings Corporation, Cleveland, OH (US)

(72) Inventors: Erin Dennis, Lakewood, OH (US); Seth Larson, Lakewood, OH (US)

(73) Assignee: American Greetings Corporation, Cleveland, OH (US)

( * ) Notice: Subject to any disclaimer, the term of this patent is extended or adjusted under 35 U.S.C. 154(b) by 0 days.

(21) Appl. No.: 15/385,995

(22) Filed: Dec. 21, 2016

(51) Int. Cl.

| | |
|---|---|
| ***B42D 15/02*** | (2006.01) |
| ***G09F 27/00*** | (2006.01) |
| ***G09F 1/10*** | (2006.01) |
| ***B42D 15/04*** | (2006.01) |

(52) U.S. Cl.
CPC ..... *B42D 15/022* (2013.01); *B42D 15/042* (2013.01); *B42D 15/045* (2013.01); *G09F 1/10* (2013.01); *G09F 27/00* (2013.01); *G09F 2027/002* (2013.01)

(58) Field of Classification Search
CPC ... B42D 15/022; B42D 15/042; B42D 15/045
See application file for complete search history.

(56) References Cited

U.S. PATENT DOCUMENTS

| | | | | |
|---|---|---|---|---|
| 2004/0093773 | A1* | 5/2004 | Clark | B42D 15/045 40/124.06 |
| 2005/0230460 | A1* | 10/2005 | Ristau | B42D 15/042 229/92.8 |
| 2013/0104431 | A1* | 5/2013 | Jin | G09F 1/04 40/124.03 |
| 2013/0139418 | A1* | 6/2013 | Bogdanski | B42D 15/022 40/124.03 |
| 2013/0232828 | A1* | 9/2013 | Qiao | B42D 15/022 40/124.03 |
| 2013/0239448 | A1* | 9/2013 | Davis | B42D 15/022 40/124.03 |
| 2013/0269225 | A1* | 10/2013 | Nelson | B42D 15/022 40/124.03 |
| 2014/0360064 | A1* | 12/2014 | Mayer | B42D 15/022 40/124.03 |
| 2015/0170557 | A1* | 6/2015 | Spuzzillo | G09F 19/02 40/124.03 |
| 2015/0314950 | A1* | 11/2015 | Lopez | B65D 5/422 206/232 |
| 2016/0159135 | A1* | 6/2016 | Talbot | B42D 15/042 40/124.03 |

* cited by examiner

*Primary Examiner* — Gary C Hoge
(74) *Attorney, Agent, or Firm* — Christine Flanagan

(57) ABSTRACT

A greeting card having a miniature model of a faux harp attached thereto with a die cut character attached to a motor which effects movement of the die cut character such that it appears the die cut character is playing the faux harp.

15 Claims, 6 Drawing Sheets

MUSICAL GREETING CARD

RELATED APPLICATIONS

There are no applications related to this application.

FIELD OF THE INVENTION

The present invention is in the field of social expression products and more specifically to greeting cards with interactive audio capabilities.

SUMMARY OF THE INVENTION

A greeting card having a multi-panel greeting card body, a die cut character appearing on a front surface of the greeting card, a faux musical instrument attached to the greeting card body proximate to the die cut character, a sound module, a motor module, and a switch. Activation of the sound module causes playback of at least one audio file through a speaker and activating the motor module causes a portion of the die cut character to move.

DETAILED DESCRIPTION OF PREFERRED AND ALTERNATE EMBODIMENTS

The present disclosure and related inventions include a greeting card with user initiated audio playback and motor for effecting movement of at least a portion of an object shaped as a character playing a faux musical instrument.

Figure 5:
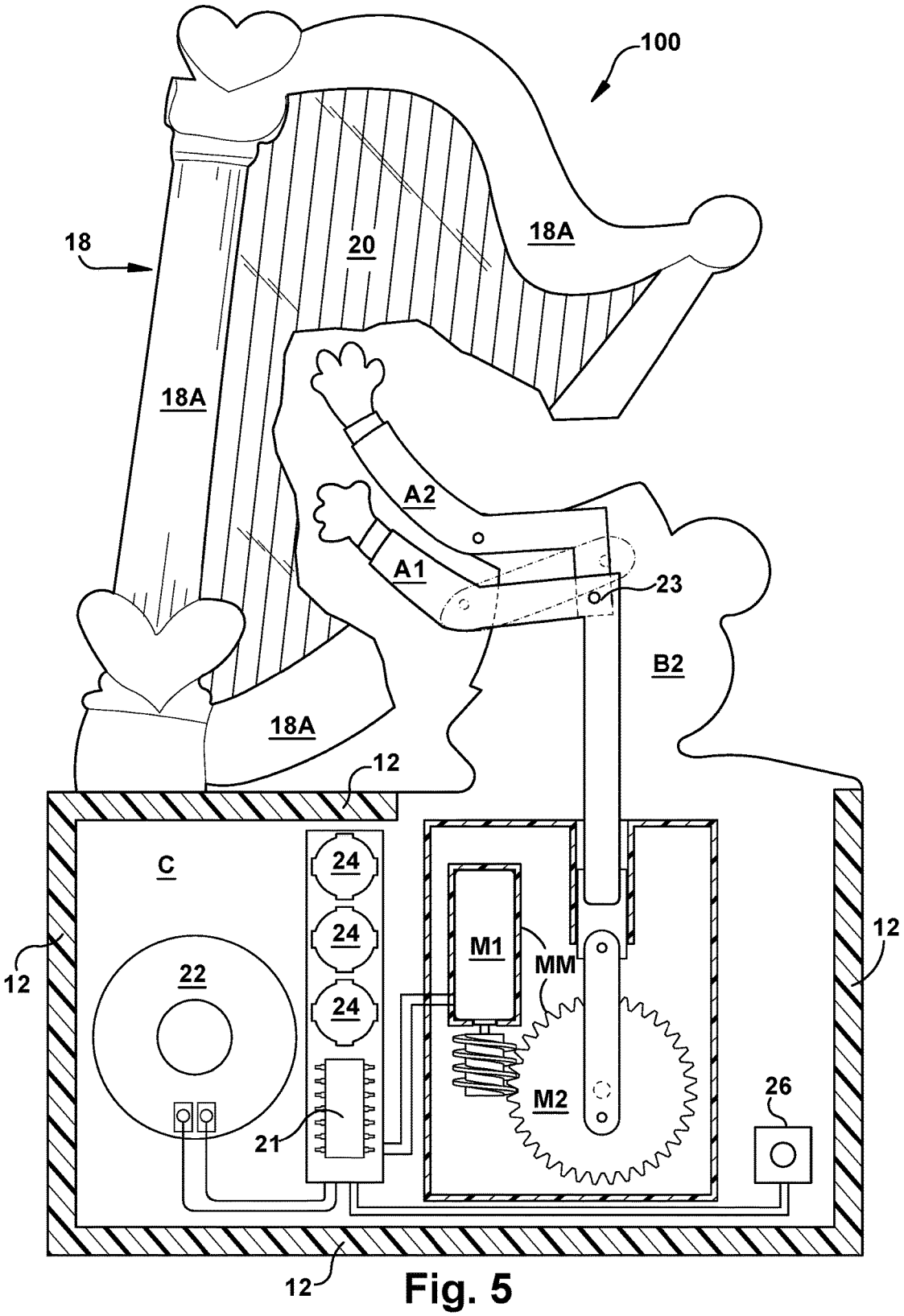
FIG. 5 is a front, tear-away view of the greeting card of FIG. 1 from the perspective of arrows 5-5.
Figure 6:
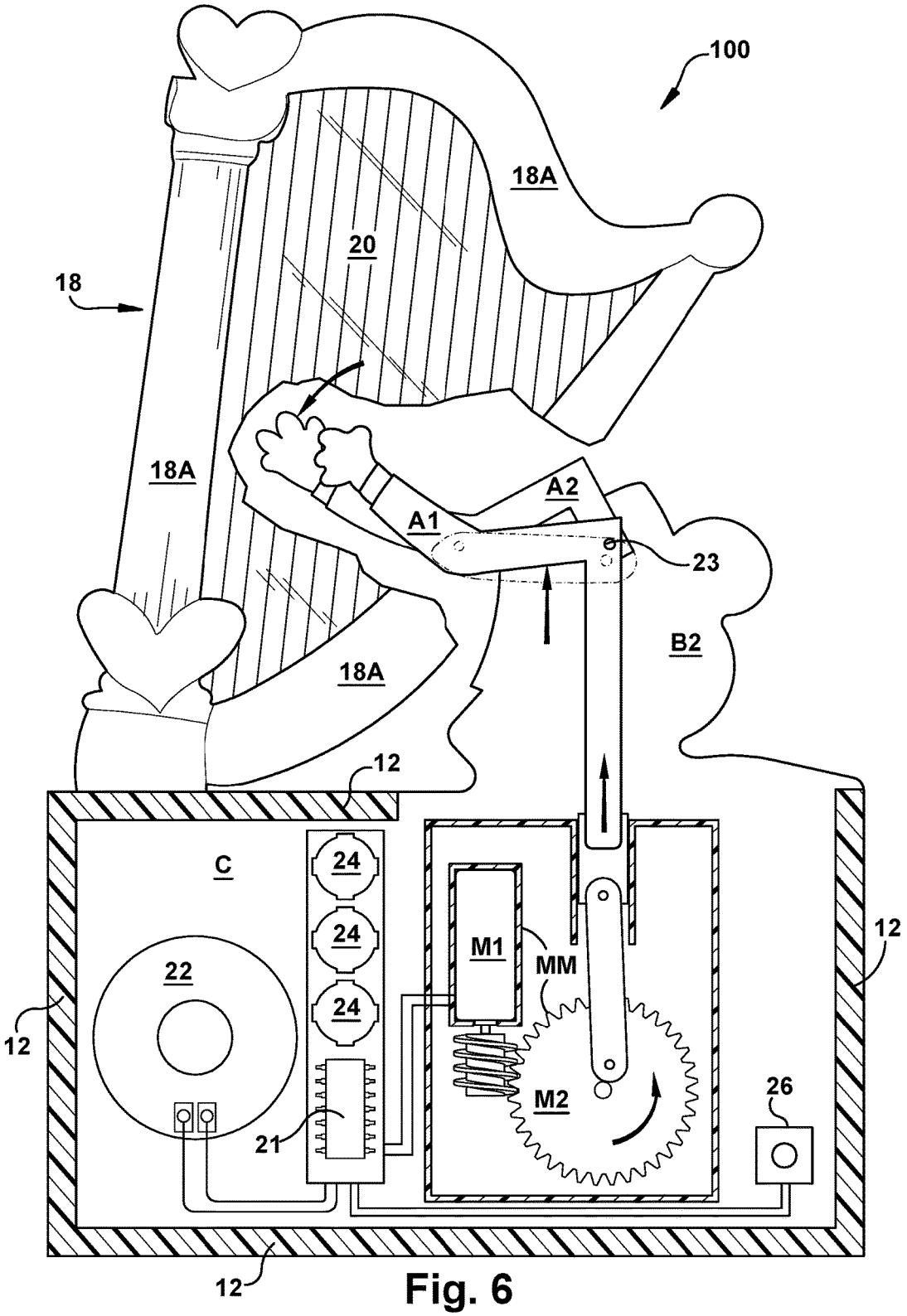
FIG. 6 is a front, tear-away view of the greeting card of FIG. 5, with movement arrows.
Figure 7:
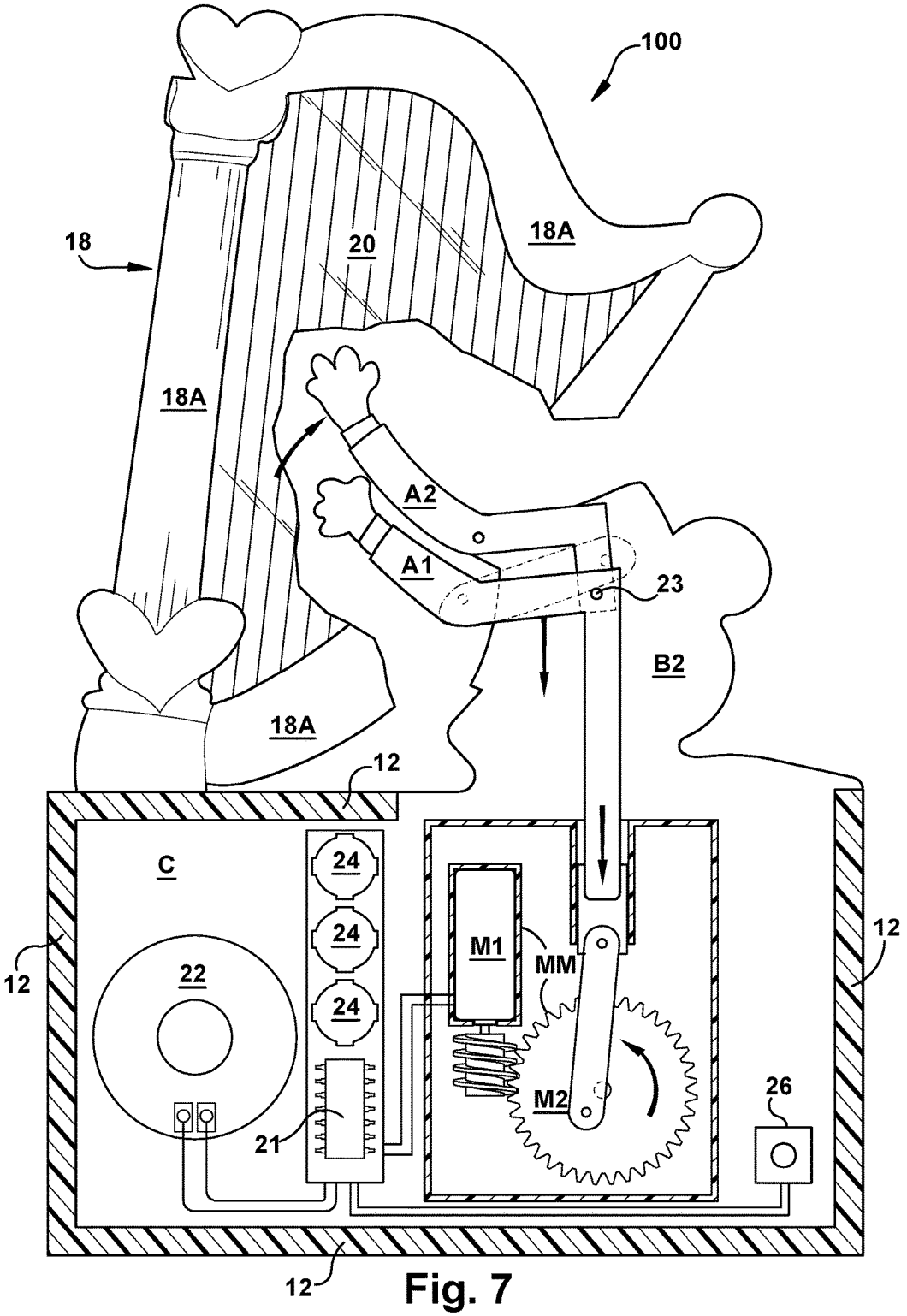
FIG. 7 is a front, tear-away view of the greeting card of FIG. 5, with movement arrows.

The greeting card 100 has a non-traditional shape with four greeting card pages (front or cover page 10A, inside left 10B, inside right 10C, and back or rear page 10D) having a substantially rectangular shaped partial greeting card panel. A rectangular frame 12 exists beneath and between the first (cover page) 10A and second (inside left) 10B greeting card pages creating a depth with a cavity C between the first 10A and second 10B pages and two side perimeter panels 14 which extend perpendicularly between the first 10A and second 10B pages, as shown in FIGS. 5 through 7. The four greeting card pages 10A-10D and two side perimeter panels 14 are created from a single contiguous panel having various vertical fold lines. However, separate panels may be used in place of the single contiguous panel. The panels 10A-10D may contain printed sentiment, drawings, photos, artwork, or any other printed matter. Additional embellishments may be attached thereto. The third (right inside) 10C and fourth (back or rear) 10D panels serve as a sentiment panel wherein a user may write a personal note or add his/her signature.

Figure 1:
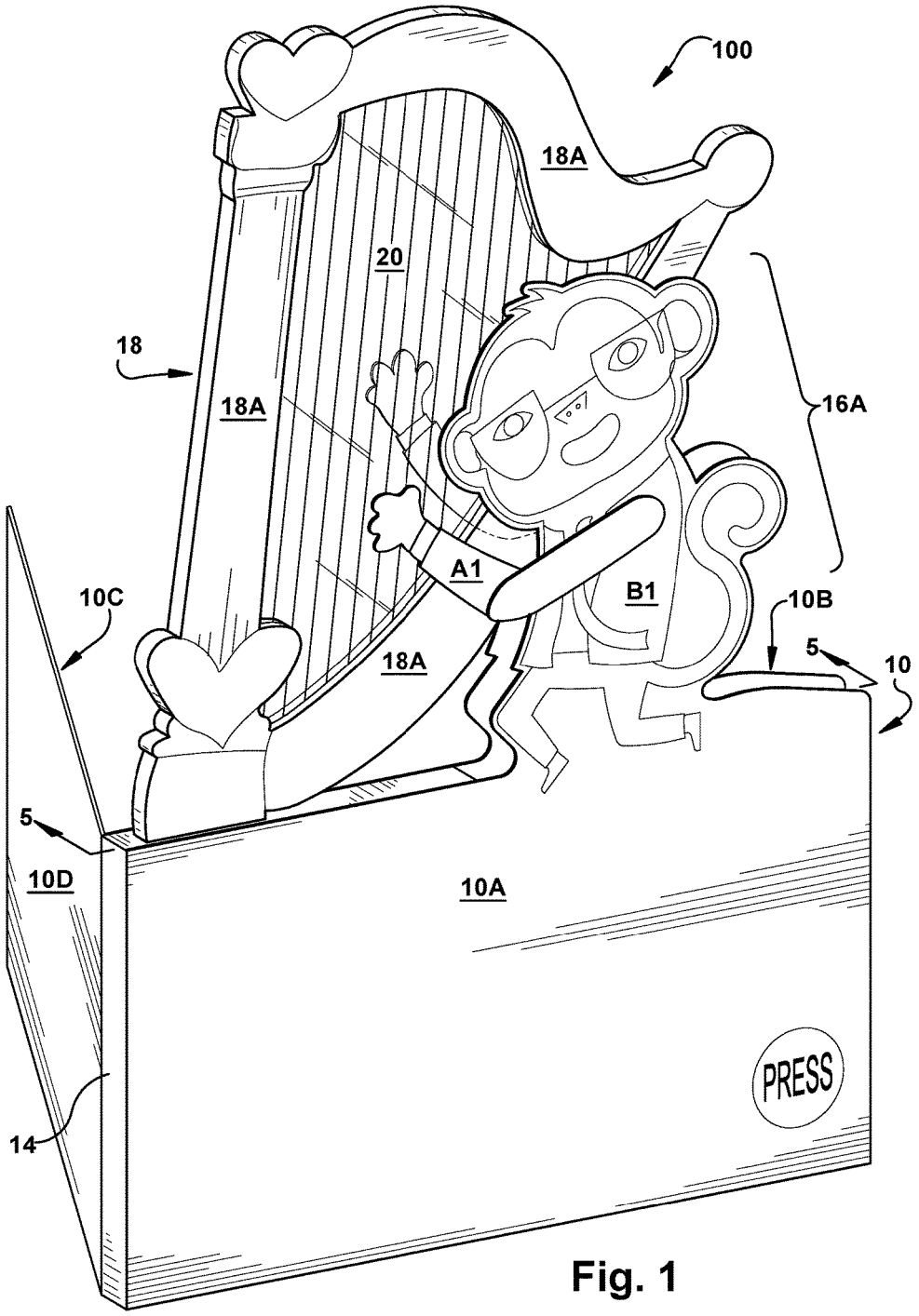
FIG. 1 is a perspective view of the greeting card of the present invention.
Figure 2:
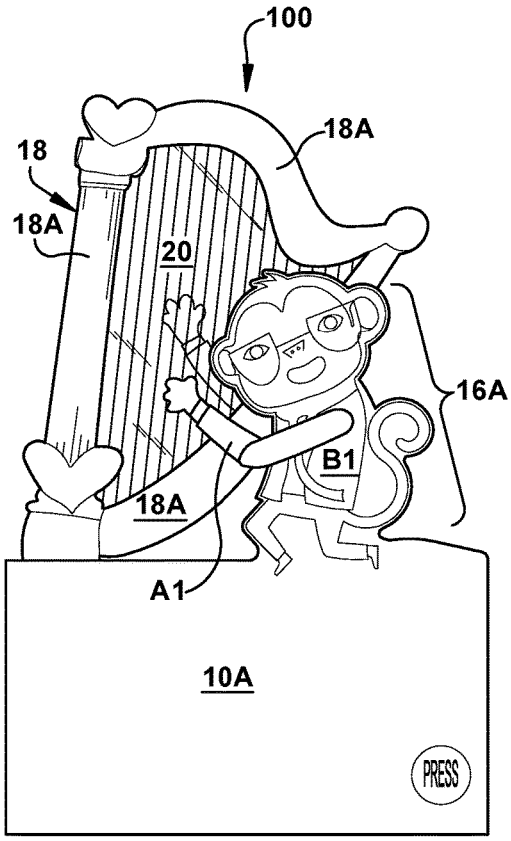
FIG. 2 is a front view of the greeting card of FIG. 1.
Figure 3:
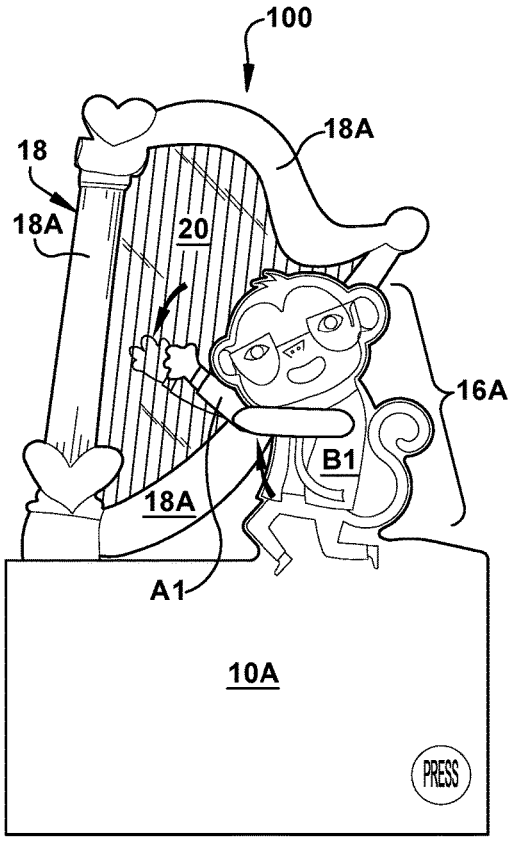
FIG. 3 is a front view of the greeting card of FIG. 1 with arrows showing movement direction.
Figure 4:
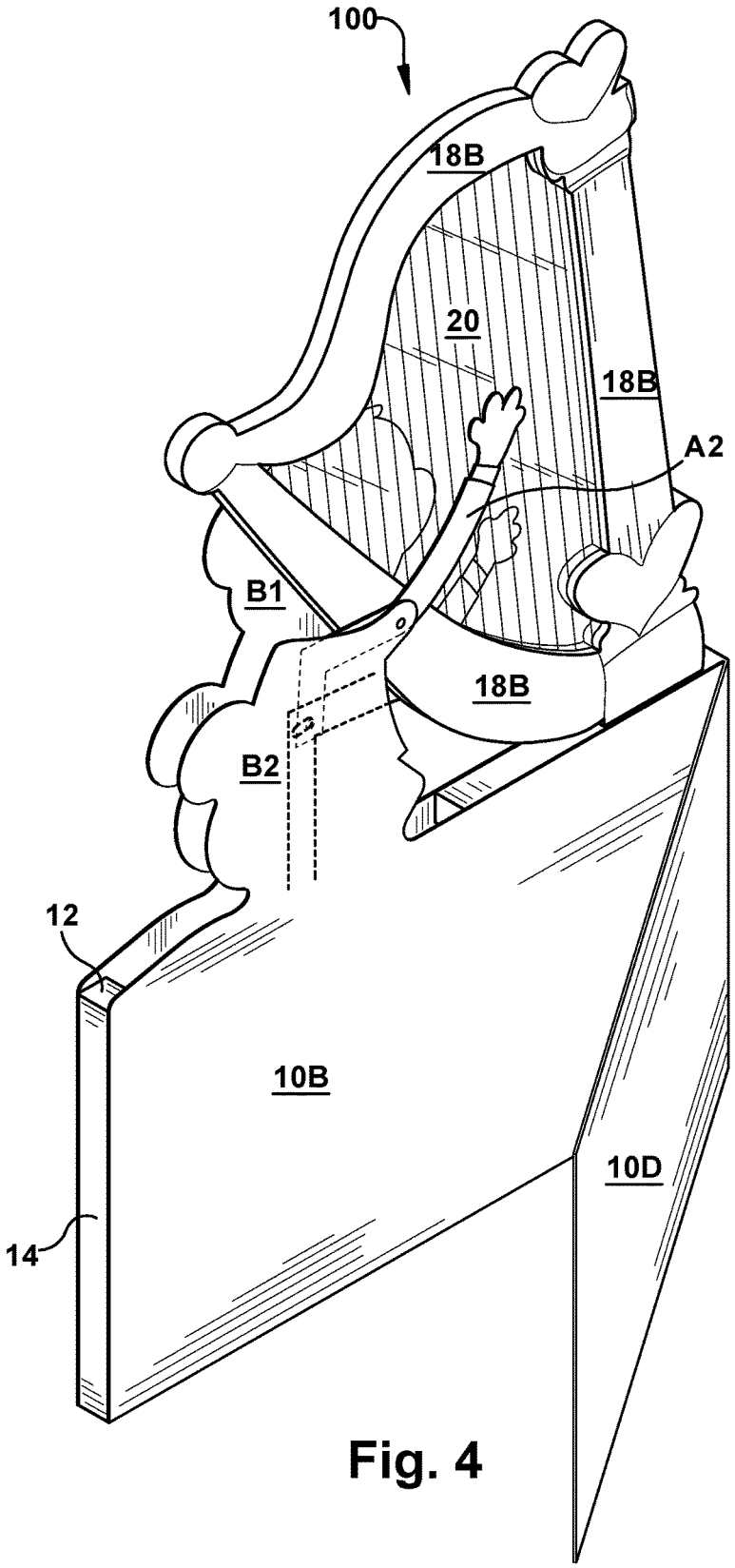
FIG. 4 is a rear perspective view of the greeting card of FIG. 1.

The first 10A and second 10B pages of the greeting card 100 additionally contain the shape of a character 16 extending upward from the lower rectangular portion of the greeting card 100. The character 16 may be in the shape of a monkey (as shown in the Figures), a dog, a cat, a fox or any other animal, person, cartoon or movie character, etc. The character 16 contains a single head and body portion B with an arm portion A attached thereto. As shown in FIGS. 1 through 3, the portion of the character 16 shown on the first page (cover or front page) 10A of the greeting card 100 contains printing thereon (and optionally additional embellishments) indicating a front view 16A (B1, A1) of the character 16. The portion of the character 16 shown on the second page 10B of the greeting card 100 contains printing thereon (and optionally additional embellishments) indicating a rear view 16B (B2, A2) of the character 16, as shown in FIG. 4. The two body portions B1, B2 of the character 16 are attached to one another along an inside surface thereof. Each of the body portions B1, B2 of the character 16 has an arm portion A1, A2 attached thereto, with both arms being attached to one another about a connection point 23 on an inside surface thereof. At least one of the arms A1, A2 of the character 16 is also connected to the motor module MM, which effects movement thereof, when activated. The motor MM causes movement of at least one arm A1, A2. In of a preferred embodiment, the motor MM is attached to the arm portion A1 of the character 16A on the front page 10A of the greeting card 100 via a connection mechanism 28, as shown in FIGS. 5 through 7. Since the arm portion A1 of the character 16A on the first page 10A of the greeting card 100 is connected to the arm portion A2 of the character 16B on the second page 10B of the greeting card 100, activation of the motor module MM effects movement of both arms A1, A2.

A faux harp 18 is attached to and extends upward from a top surface of the frame 12 positioned between pages one 10A and two 10B of the greeting card 100. The faux harp 18 is a miniature model of a harp which is plastic molded into a somewhat triangular shape with three sides representing the column, neck and body of a harp. A transparent plastic sheet 20 is inserted into the open, inner portion of the harp 18, where the strings of a real harp would be attached. The faux harp 18 has a front surface 18A and a rear surface 18B opposite the front surface. The transparent sheet 20 allows both arms A1, A2 of the character 16 to be seen moving on opposing sides of the harp 18. The positioning of the many separate pieces of the character around or with respect to the faux harp 18 is intended to depict a scene wherein the character 16 is sitting near the faux harp 18 and strumming the imaginary strings (transparent panel 20) of said harp 18 (when motor module MM is activated). A portion of the harp body 18 extends between the two sides 16A, 16B of the character 16 appearing on pages one 10A and two 10B wherein the character 16A appearing on page one 10A is on a front side of the harp 18A and the character 16B appearing on page two 10B is located on the opposite side of the harp 18B. The arms A1, A2 of the character 16 are positioned in a slightly upward position to mimic the character 16 strumming the strings of a harp. While a faux harp 18 has been described herein and shown in the figures with respect to the preferred embodiment, any other faux musical instrument may be used, such as a piano, a violin, a guitar, a trumpet, a flute, a saxophone, a clarinet, or any other musical instrument. While the faux harp 18 has been described as being plastic, any other material may be used, such as cardboard, paperboard, foam, wood, or any other material.

A sound module is contained within the cavity C formed by the sheet material covering the frame 12 positioned between pages one 10A and two 10B. The sound module may include, but is not limited to: a printed circuit board 21, an integrated circuit chip, a speaker 22, a power source 24 such as one or more batteries, a memory storage device having one or more audio files stored thereon, a switch 26, and various wires and circuitry which may inter-connect one or more of the components of the sound module. Any other electronic or mechanical component that is required to or which facilitates or improves emitting sound through a speaker, which are known to one having ordinary skill in the art, may also be included in the sound module. In a preferred embodiment, the switch 26 which initiates the sound module is a push button switch which is accessed through a front surface 10A of the greeting card 100. In alternate embodiments, other switch mechanisms may be used such as a slide switch, magnetic switch, contact switch, touch-sensitive switch, light sensitive switch, motion sensor or any other type of switch.

A motor module MM is also contained within the cavity C between pages one 10A and two 10B of the greeting card 100. The motor module MM effects movement of at least one of the arm portions A1, A2 of the character 16 appearing on pages one 10A and two 10B of the greeting card 100 by connection of the at least one arm portion A1, A2 to the motor module MM either directly or via a connection mechanism 28. The motor module MM may include, but is not limited to: a printed circuit board 21, an integrated circuit chip, a motor M, and a power source 24 such as one or more batteries, and various wires and circuitry which may inter-connect one or more of the components of the motor module. Any other electronic or mechanical component that is required to or which facilitates or improves using a motor to effect movement of one or more mobile objects, which are known to one having ordinary skill in the art, may also be included in the motor module. In a preferred embodiment, the motor module MM includes a gear rotating mechanism M1 which turns a circular gear M2, as shown in FIGS. 5 through 7. The gear M2 is attached to a connection mechanism 28 which is also attached to the one or more moveable portions (arms) A1, A2 of the greeting card 100. Since the two arm portions A1, A2 are connected to one another at connection point 23, movement of the first arm portion A1 via connection to the circular gear M2 also causes movement of the second arm portion A2. The gear M2 is moved in a circular motion which causes the connection mechanism 23 to move the first arm portion A1 in an up and down direction, as shown in FIGS. 6 and 7. In a preferred embodiment, the switch 26 which controls activation of the motor module MM is a push button switch which is accessed through the front surface 10A of the greeting card 100. In alternate embodiments, other switch mechanisms may be used such as a slide switch, magnetic switch, contact switch, touch-sensitive switch, light sensitive switch, motion sensor or any other type of switch. Other types of miniature motors may be used as well, in place of the motor described herein and shown in the figures. Also, while the mobile portions of the greeting card 100 have been described herein and shown in the figures as being the arm portions A1, A2 of the character 16, additional or alternate mobile portions may be included in other embodiments.

In operation, the user may push the push button switch 26 which is accessed through the front surface or cover panel 10A of the greeting card 100. The push button switch 26 controls activation of both the sound module and the motor module MM. The sound module emits playback of the at least one audio file through the speaker 22. The motor module MM causes at least one of the arm portions A1, A2 of the character 16 to move in an up-and-down motion. Since the two arm portions A1, A2 are angled upward and at different elevations, the movement of the arms A1, A2 simulate the character 16 strumming the strings of a harp 18. The audio file and motor movement may continue for a pre-determined amount of time or until the user pushes the push button 26 a second time while the sound and motor modules MM are activated. If the sound and motor modules MM are activated for the pre-determined amount of time and then stop, a second push of the push button 26 will re-activate the sound and motor MM modules. The user may open the greeting card 100 by moving pages one 10A and two 10B (cover and left inside panel) away from pages three 10C and four 10D (inside right and rear panel) to reveal text sentiment, artwork, photos, drawings or other printing thereon or user entered sentiment or signature.

In an alternate embodiment, the greeting card of the present disclosure and related inventions includes a gift card holder for storing a gift card therein. As used herein, the term "gift card" is defined as being a monetary equivalent issued by retailers or banks to be used as an alternative to a non-monetary gift. Gift cards are legal tender purchased for use by a consumer and useable in its face amount in lieu of cash in exchange for goods and services supplied by the seller. Gift cards typically resemble a credit card or display a specific theme on a plastic card having a magnetic strip or bar code thereon which contains the dollar amount of the gift card. The term "gift card" is also intended to cover other non-gift card items which can be held in the "gift card holder" or other holding or containment mechanism described herein for holding a gift card. Such non-gift card items include, but are not limited to: cash, gift certificates, checks, vouchers, coupons, notes, lottery tickets, tickets to entertainment events, calling cards, business cards, collectable cards, small gift items or cards or coins or other substrate with a QR code, digital watermark, bar code (or other digital code or mark which can be decoded) having stored therein or being linked to digital or electronic content such as games, music, videos, movies, books, magazine subscriptions, photographs, or other such digital content. The gift card holder may be in the form of an open-sided pocket or sleeve into which a gift card may be inserted and removed. The pocket or sleeve may cover a substantial portion of the greeting card or it may cover only a portion of the greeting card. In a preferred embodiment, the gift card pocket or sleeve is rectangular shaped (similar to but slightly larger than the size of a traditional gift card) having an opening along the top, right, or left edge thereof for insertion and removal of the gift card. The front surface of the gift card pocket or sleeve may be completely or partially transparent so that the recipient can view at least a portion of the gift card contained within the sleeve or pocket. The gift card holder may alternately be in the form of a closed pocket which may be opened and closed for insertion and removal of a gift card. The pocket may have a flap which can be lifted to reveal a gift card inside or a slot which can be contained on a front face of the sleeve or pocket, or any such opening for inserting and removing a gift card. The gift card holder may be contained on a front or outside surface of the greeting card or may be contained on an inside surface of the greeting card. The gift card may alternatively be inserted and removed from the faux harp 18 portion of the greeting card. An opening may be contained in the top or side portion of the faux harp 18 for insertion and removal of the gift card. The gift card may be visible through the transparent sheet 20 contained between the open, inner portion of the faux harp 18. There may be two transparent sheets with a cavity or slot therebetween into which a gift card may be inserted and removed. In another embodiment, removal of a gift card from the gift card holder may trigger audio playback through the speaker or may additionally or alternatively trigger a motor module which causes movement of a mobile object. The gift card holder may or may not be a part of the mobile object.

While the present disclosure and related inventions are described herein and shown in the figures with respect to a preferred embodiment, various changes may be made to the shape, number of pages, pages on which certain components are located, location of the sound and motor modules, type and number of switches, shapes of character and faux harp (other faux instruments may be used), without deviating from the scope of the present disclosure and related inventions. The foregoing embodiments of the present invention have been presented for the purposes of illustration and description. These descriptions and embodiments are not intended to be exhaustive or to limit the invention to the precise form disclosed, and obviously, many modifications and variations are possible in light of the above disclosure. The embodiments were chosen and described to best explain the principle of the invention and its practical applications to thereby enable others skilled in the art to best utilize the invention in its various embodiments and with various modifications as are suited to the particular use contemplated. It is intended that the invention be defined by the following claims.

The invention claimed is:

1. A greeting card comprising:

a multi-panel greeting card body;

a die cut character appearing on a front surface of the greeting card;

a faux musical instrument attached to the multi-panel greeting card body proximate to the die cut character;

a sound module contained within the multi-panel greeting card body, the sound module having at least one audio file saved thereon;

a motor module contained within the multi-panel greeting card body;

a switch to activate the sound and motor modules;

wherein activating the sound module causes playback of the at least one audio file through a speaker and activating the motor module causes a portion of the die cut character to move; and wherein a first portion of the die cut character is located in front of the faux musical instrument and a second portion of the die cut character is located behind the faux musical instrument.

2. The greeting card of claim 1, wherein the faux musical instrument is a harp.

3. The greeting card of claim 1, wherein a single switch activates both the sound and motor modules.

4. The greeting card of claim 1, wherein the switch is a press button switch.

5. The greeting card of claim 1, wherein the switch is accessed through a front cover of the multi-panel greeting card body.

6. The greeting card of claim 1, wherein the die cut character and the faux musical instrument are not contained within the multi-panel greeting card body.

7. The greeting card of claim 1, wherein the die cut character and the faux musical instrument are located above the multi-panel greeting card body.

8. A greeting card comprising:

a greeting card body having at least one cavity therein;

a sound module contained within the at least one cavity in the greeting card body;

a motor module contained within the at least one cavity in the greeting card body;

a miniature model of a musical instrument positioned above the greeting card body;

a die cut character comprising a front side, a rear side, a head and two arms;

a switch which causes activation of the sound and motor modules;

wherein activating the sound and motor modules causes playback of the at least one audio file and also causes the motor to effect movement of at least a portion of the die cut character to simulates the character playing the musical instrument; and wherein the front side, head and one of the two arms of the die cut character are located on one side of the miniature model and the rear side and one of the two arms of the die cut character are located on an opposite side of the miniature model.

9. The greeting card of claim 8, wherein the miniature model is a harp.

10. The greeting card of claim 8, wherein the switch is a press button switch.

11. The greeting card of claim 8, wherein the two arms the die cut character move when the motor module is activated.

12. A greeting card comprising:

A greeting card body having at least one cavity therein and a sentiment panel;

a sound module operative to store and playback at least one audio file upon activation, the sound module contained within the at least one cavity in the greeting card body;

a motor module operative to effect movement of a mobile object upon activation, the motor module contained within the at least one cavity in the greeting card body;

a faux musical instrument attached to the greeting card body and located proximate to the mobile object;

a switch which controls activation of the sound and motor modules;

wherein activation of the sound module causes replay of the at least one audio file and activation of the motor module causes the mobile object to move; and wherein the faux musical instrument is partially inserted between two portions of the mobile object.

13. The greeting card of claim 12, wherein the faux musical instrument is a harp.

14. The greeting card of claim 12, wherein the switch is a press button switch.

15. The greeting card of claim 12, wherein the mobile object is a die cut character with at least one moveable part.

* * * * *